United States Patent [19]

Woertz

[11] 4,269,471

[45] May 26, 1981

[54] ELECTRICAL TERMINAL FOR ATTACHMENT TO A CONTACT BAR

[75] Inventor: Hans Woertz, Basel, Switzerland

[73] Assignee: Oskar Woertz, Switzerland

[21] Appl. No.: 69,544

[22] Filed: Aug. 24, 1979

[30] Foreign Application Priority Data

Aug. 29, 1978 [CH] Switzerland ..... 9109/78

[51] Int. Cl.[3] ..... H01R 9/24

[52] U.S. Cl. ..... 339/198 GA; 339/272 R

[58] Field of Search ..... 339/198 AU, 272 R, 272 A

[56] References Cited

U.S. PATENT DOCUMENTS

Re. 25,442 9/1963 Blanchet ..... 339/198 GA

FOREIGN PATENT DOCUMENTS 261714 7/1963 Australia ..... 339/198 GA 1590344 7/1973 Fed. Rep. of Germany ... 339/198 GA

*Primary Examiner*—Eugene F. Desmond

*Attorney, Agent, or Firm*—Watson, Cole, Grindle & Watson

[57] ABSTRACT

This electrical terminal is for attachment to a contact bar of U-shaped cross-section with outwardly projecting flanges of the limbs of the U. Two claws extending towards each other are arranged on a retaining foot of the terminal for engaging the two flanges. Between each claw and the retaining foot, there is a recess for accommodating one of the flanges. A clamping body projects into the recesses by way of its opposite end portions and may be forced away from the retaining foot by way of a locking screw threaded into the retaining foot so that each flange can be clamped rigidly between the claws and one end portion of the locking body. Mutually slidingly engaging guiding surfaces on the locking body and the retaining foot respectively prevent displacement and rotation of the clamping body relative to the retaining foot. The side of the body remote from the retaining foot has two inclined surfaces which co-operate with the limbs of the U-shaped contact bar that carry the flanges to effect an automatic centering of the terminal relative to the cross-section of the contact bar.

8 Claims, 4 Drawing Figures

ELECTRICAL TERMINAL FOR ATTACHMENT TO A CONTACT BAR

BACKGROUND OF THE INVENTION

1. Field of the Invention

The present invention concerns an electric terminal for attachment to a contact bar or carrying rail which has a U-shaped cross-section with outwardly projecting flanges at the coplanar ends of the shanks of the U which terminal has a retaining foot with claws directed towards each other for engaging the two flanges of the contact bar, wherein a recess is provided between each claw and the retaining foot for accommodating one of the flanges of the contact bar.

2. Description of the Prior Art

Contact bars or carrying rails of this type are frequently used for mounting electrical terminal blocks and wiring apparatus and expediently have standardised cross-sectional dimensions according to (German standard) DIN 46277, Sheet 2, 3 or 4 or according to European Standard EN 50022.

Electrical terminals of the above-mentioned characteristics are shown for instance in Swiss patent specification No. 531,266; according to FIGS. 2, 3 and 6 of this specification the claws are formed on resiliently bendable limbs and are so constructed that on pressing the terminal against the flanges of the contact bar, they automatically spring back and finally under the resilient effect of the limbs, snap automatically under the flanges. Also, this terminal may without further measures be pulled off the contact bar by overcoming the retaining force exerted by the resilient limbs and claws on the flanges. Furthermore, a terminal of the above-mentioned type is known, e.g. from West German patent specification No. 2,051,781 wherein one of the two mutually oppositely lying claws is constructed to be rigid whilst the other is resiliently yieldable and is made from spring wire or leaf spring material. In both of these mentioned cases the retention of the terminal on the contact bar is sufficient mechanically to fix the terminal but is insufficient to provide a completely objection-free electrically conductive coupling between the contact bar and the retaining foot of the terminal, such as is required e.g. for protective earthing (grounding).

However, from Swiss patent specification No. 532,253 a terminal of the above-mentioned kind is known wherein the two mutually oppositely lying claws are constructed rigidly and one of these claws is associated with an adjusting screw, which enables the relevant flange of the contact bar to be rigidly clamped between the said claw and one of the ends of the adjusting screw in order mechanically to fix the terminal on the contact bar and simultaneously to ensure good electrical connection between the contact bar and the terminal, insofar as the retaining foot and the claws as well as the contact bar are made of metal. In this way, a terminal of the last-described kind may also be used, e.g. as a protective conductor terminal. A certain disadvantage may be seen in that the other claw, not being associated with an adjusting screw of its own, is not clamped rigidly to the same extent to the contact bar. To remove this disadvantage a second adjusting screw would be necessary.

SUMMARY OF THE PRESENT INVENTION

The task of the present invention is to provide an electrical terminal of the above-mentioned kind wherein the mutually oppositely lying claws may frictionally be connected to the flanges of the contact bar with a single locking screw to make it possible to provide an improved retention of the terminal on the contact bar and an improved electrical connection between the contact bar and the terminal.

This task is achieved according to the invention by means of the terminal having the characteristics according to claim 1.

BRIEF DESCRIPTION OF THE DRAWING

Details and further characteristics of special embodiments of the terminal according to the invention will become clear from the other patent claims as well as from the description of exemplary embodiments given below and from the associated drawings in which:

In FIGS. 1 and 2, 10 designates a contact bar or carrying rail which is made of metal and has a U-shaped cross-section given by a web 11 of the U and two limbs 12 of the U, from which latter oppositely outwardly directed flanges 13 project. The contact bar 10 is symmetrically constructed relative to a central longitudinal plane and preferably has standardised dimensions according to (German Standard) DIN 46277, Sheet 2, 3 or 4.

Figure 1:
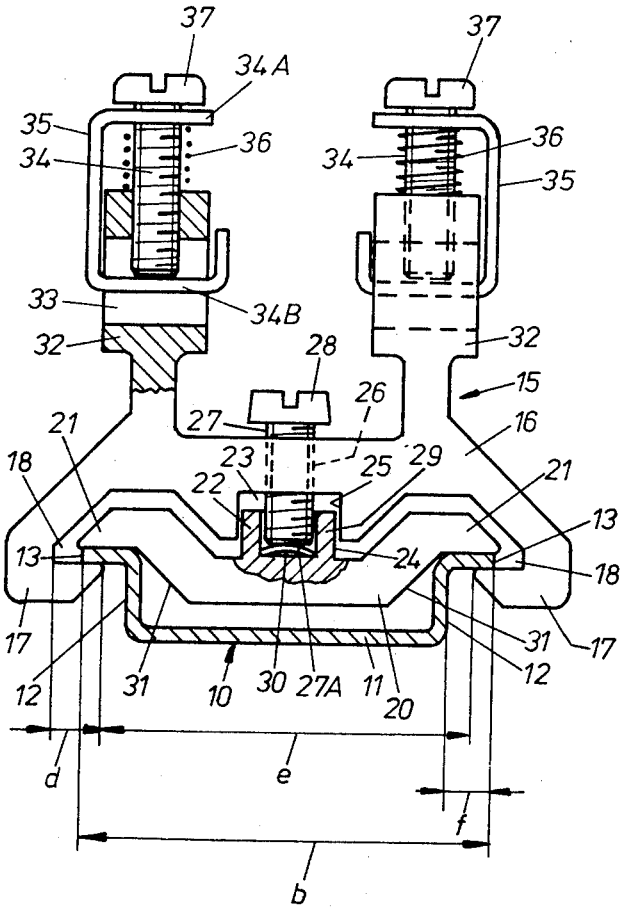
FIG. 1 is a first examples of an electric twin terminal attached to a contact bar and shown partly in elevation in the longitudinal direction of the contact bar, and partly in vertical section.

An electrical terminal 15 made completely of electrically conductive materials is releasably secured on the contact bar 10. The terminal 15 has a retaining foot 16 with two mutually oppositely lying claws 17 constructed in mirror-fashion and which serve to surround or engage a respective flange 13 of the contact bar 10. Between each claw 17 and the underside of the retaining foot 16 a recess 18 is provided for accommodating the associated shank or flange 13 of the contact bar. By designating in FIG. 1 the total width of the contact bar 10 measured between the outermost edges of the two flanges 13 with b, the width of the individual flanges with f, the clear distance between the mutually facing ends of the claws with e and the depth, measured in the same direction, of an individual recess 18 with d, then the following relations are valid:

$$b \leqq e+d$$

$$e \geqq b-f$$

In this way it is achieved that the terminal 15 can be brought into and out of engagement with the flanges 13 of the contact bar 10 at any position along the latter in that the terminal 15 is displaced transversely of the contact bar until one of the flanges 13 is out of the range or reach of the adjacent claw 17 and the latter can be displaced unhindered past the said flange.

Beneath the retaining foot 16 a terminal body or clamping body 20 is arranged the opposite end portions 21 of which engage in a respective recess 18 between the claws 17 and the retaining foot 16, and serve to lie against the flanges 13 of the contact bar 10. The opposite ends of the clamping body 20 are spaced from each other by a distance which is greater than the clear distance e between the mutually facing ends of the claws 17. At the central portion of the clamping body 20, and more particularly on its upper side facing the retaining foot, the clamping body 20 has a parallelepipedal projection 22 which engages with play in a groove-like recess 23 in the retaining foot 16. The projection 22 and the recess 23 each have a pair of parallel planar outer surfaces 24 and flasks 25 which slidingly engage each other and serve as guiding surfaces to guide the displacement of the clamping body 20 relative to the retaining foot 16, so that the clamping body may be moved towards and away from the retaining foot and thus is secured against displacements towards one or other of the claws 17 as well as against rotation relative to the retaining foot 16.

A threaded bore 26 passes through the retaining foot 16 and a locking screw 27 is screwed into it. The end of the locking screw 27 remote from the clamping body 20, which is its upper end in FIG. 1, has a head 28 for engagement by screwdriver with the aid of which the locking screw can be turned. The opposite lower end portion of the locking screw 27 engages with radial play in a recess 29 in the projection 22 of the clamping body 20, and that end 27A of the screw 27 is formed as a pressure surface serving to press against an arcuate plate spring 30 disposed at the bottom of the recess 29.

At the side remote from the retaining foot 16, that is in FIG. 1, the lower side, of the clamping body 20 there are two mutually oppositely inclined oblique surfaces 31 which converge in a downward direction. The upper ends of the inclined surfaces 31 adjacent the end portions 21 of the clamping body 20 have a spacing which approximately corresponds to the spacing between the limbs 12 of the U of the contact bar 10. The inclined surfaces 31 serve for the central alignment or centering of the clamping body 20 relative to the plane of symmetry of the contact bar 10. Both the retaining foot 16 with the claws 17 as well as the clamping body 20 are symmetrical relative to the plane that contains the longitudinal access of the locking screw 27.

The side of the retaining foot 16 remote from the claws 17 and the clamping body 20, the upper side in FIG. 1, carries two similarly constructed cable or line clamps 32–37. Each of these has a clamping body 32 with a transverse bore 33 for receiving at least one electrical conductor. An end of a clamping screw 34 projects into the bore 33 for clamping the conductor. An essentially U-shaped stirrup 35 is associated with the clamping screw 34 and has two shanks 35A, 35B. The upper shank 35A has a bore therethrough which has radial play with respect to the screw 34 while the lower shank 35B passes through the transverse bore 33 of the clamping body 32 and is disposed directly before the end of the clamping screw 34. A coil spring 36 surrounds the clamping screw 34 and is disposed between the upper shank 35A of the stirrup 35 and the free end of the clamping body 32. The coil spring 36 urges the stirrup 35 in the direction against the head 37 of the clamping screw 34 so that the lower shank 35B of the stirrup 35 which traverses the transverse bore 33 always remains in engagement with the lower end of the clamping screw 34. The clamping bodies 32 are arranged symmetrically in relation to the longitudinal axis of the locking screw 27 so that the head 28 of the locking screw 27 between the clamping bodies 32 is readily accessible and can be turned by means of a screwdriver.

The retaining foot 16, the claws 17 and the two clamping bodies 32 are made of a single piece of material, e.g. from brass. It may be seen from FIG. 2 that the said piece of material, as seen transversely to the contact bar 10 is formed flat and neither the clamping body 20 nor other portions of the terminal project beyond the plane end faces 38 of the said piece of material. In this way, it becomes possible to bring together a plurality of terminals of the above-described kind in a space-saving manner closely adjacent to each other on the contact bar 10.

Figure 2:
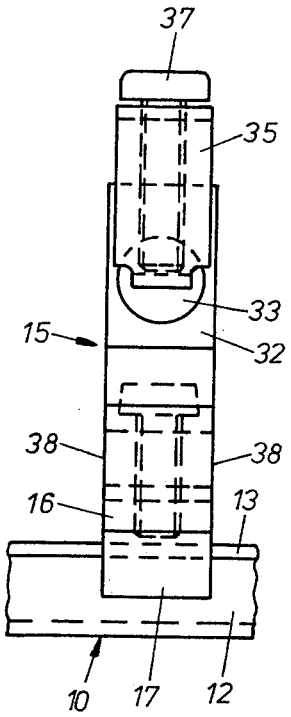
FIG. 2 is an elevation of the same terminal and contact bar at right angles to the longitudinal direction of the contact bar.

The mode of use and operation of the described terminal 15 is as follows:

It is first assumed that the terminal 15 is mounted on the contact bar 10 in the manner shown in FIGS. 1 and 2. The locking screw 27 is tightened so that its end remote from the head 28 presses against the clamping body 20 via the disc spring 30 and the latter presses the clamping 20 away from the retaining foot 16. In this way, the two flanges 13 of the contact bar 10 are rigidly clamped between the respective claws 17 and end portions 21 of the clamping body 20, whereby always relatively large surface areas are pressed against each other. This clamping of both of the flanges 13 ensures therefore not only a first class mechanical retention of the terminal 15 on the contact bar 10, but also at the same time an objection-free electrical connection between the contact bar and the terminal, e.g. for protective earthing (protective grounding). Under the influence of the resilience of the disc spring 30 the tightened locking screw 27 is secured against unaided release.

To release the terminal 15 from the contact bar 10 and to take it off, the locking screw 27 is turned via its head 28 in such a manner that the pressure on the clamping body 20 is released and a certain play between the end of the screw 27 remote from the head 28 and the spring disc 30 or the bottom of the recess 29 is achieved. In this way, the clamping of the flanges 13 is released and the clamping body 20 can move somewhat towards the retaining foot 16. Then the terminal 15 is displaced transversely of the contact bar 10 until one of the flanges 13 of the contact bar engages practically over the whole of its width with the recess 18 between the adjacent claw 17 and the retaining foot 16 and the opposite flange 13 is fully out of engagement with the opposite claw 17. Now the terminal 15 can be lifted from one side by the disengaged flange 13 of the contact bar 10 and thereafter it can also be released from the other flange by displacing the terminal in the opposite transverse direction of the contact bar.

When the terminal 15 has been taken off the contact bar 10 the clamping body 20 is secured against an undesired fully separation from the retaining foot 16 so long as the locking screw 27 is still in engagement with the recess 29 of the clamping body, with the end portions 21 of the clamping body directly engaging the claws 17. Since in the last-mentioned position of the clamping body 20 the guiding surfaces 24 and 25, respectively, on the projection 22 of the clamping body and the recess 23 of the retaining foot 16 are still in mutual engagement, it is thereby simultaneously also prevented that the clamping body 20 should be able to turn relative to the retaining foot 16 about the longitudinal axis of the locking screw 27. If such a rotation were not prevented, it would have the consequence of disengaging the end portions 21 of the clamping body 20 from the claws 17 at the retaining foot 16, whereby fully to free the clamping body which could then fall off the screw 27 and the retaining foot 16.

When the locking screw 27 is slackened to attach the terminal 15 to a contact bar, the flange 13 of the contact bar is brought into engagement with the relevant recess 18 between one of the claws 17 and the retaining foot 16 to such a depth that the oppositely lying claw 17 can be moved past the outermost end of the opposite flange 13. Then the terminal 15 is pessed against the contact bar 10 so that the clamping body 20 comes to lie against the flanges 13, with the two inclined surfaces 31 automatically centering the clamping body relative to the cross-section of the contact bar in such a way that the plane of symmetry of the clamping body 20 and of the contact bar 10 come into coincidence. Over the mutually engaging guiding surfaces 24 and 25 in the projection 22 of the clamping body 20 and at the retaining foot 16, respectively, the movement arising in the course of the centering of the clamping body is transmitted also to the retaining foot in a direction transverse to the contact bar 10 whereby the retaining foot also is centered relative to the cross-section of the contact bar and both claws 17 engage to the same extent with the flanges 13 of the contact bar, as shown in FIG. 1. Finally, the locking screw 27 is turned in the direction to force the clamping body 20 away from the retaining foot 16, whereby the two flanges 13 of the contact bar 10 are respectively rigidly clamped between a claw 17 and an end portion 21 of the clamping body 20.

From the above description it will be clear that the terminal 15 constructed according to the invention can be clamped to or released from the two oppositely directed flanges 13 of the contact bar 10 by actuation of a single locking screw 27 and that by means of the inclined surfaces 31 of the clamping body 20 and the mutually engaging guiding surfaces 24 and 25 of the clamping body 20 and the retaining foot 16, respectively, the terminal is automatically centered relative to the cross-section of the contact bar 10 when the terminal 15 is mounted on the contact bar, after setting the terminal 15 at any desired position along the contact bar 10 in an initially asymmetric position on the contact bar. Since relatively large surface portions of the claws 17 and end portions 21 of the clamping body 20 are pressed against equally large surface portions of the two flanges 13 of the contact bar, when the locking screw 27 is tightened, good electrical contact with low contact resistance is ensured between the contact bar 10 and the terminal 15 and for this reason, the described terminal 15 is particularly suitable for producing or achieving protective earthing (protective grounding).

Figure 3:
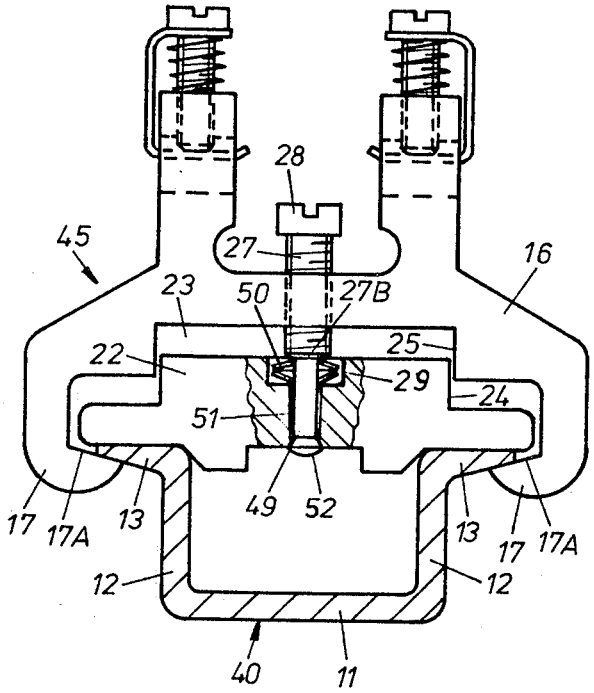
FIG. 3 is a second preferred embodiment of the subject of the invention in a view analogous to that of FIG. 1.
Figure 4:
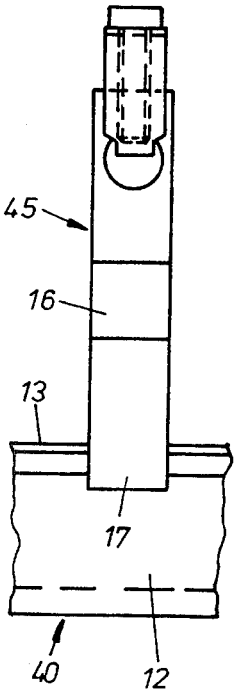
FIG. 4 is a side view of FIG. 3.

In addition to the standardised contact bars mentioned above in connection with the above-described example and conforming to DIN 46277, Sheet 2, 3 and 4, lately also contact bars with standardised cross-sectional dimensions according to European Standard EN 50022 have come into commerce and use. FIGS. 3 and 4 show such contact bars or rails 40 as well as electrical terminals 45 for use therewith, in a further embodiment of the invention. In order to avoid unnecessary repetition, identical or similar parts and elements of analogous function are designated in FIGS. 3 and 4 with the same reference numbers as in FIGS. 1 and 2. The contact bar or rail 40 according to EN 50022 shown in FIGS. 3 and 4 differs from the contact bar according to DIN 46277, Sheet 3 only in that the web 11 of the U and the two limbs 12 of the U are each thicker and that the limbs 12 have a greater height and the outwardly extending flanges taper outwardly in a wedge-like manner. The electrical terminal 45 matching this contact rail 40 and shown in FIGS. 3 and 4 is fundamentally analogous to the terminal 15 described above with reference to FIGS. 1 and 2. Consequently in what follows only the differences will be mentioned.

The claws 17 for engaging from below the flanges 13 of the carrying rail 40 have clamping surfaces 17A which are inclined to correspond to the inclination of the underside of the flanges 13 in order to ensure a sufficiently great contact surface between the flanges 13 and the claws 17. The locking screw 27 screwed into the retaining foot 16 has at its end remote from the head 28 a coaxial cylindrical extension 49 the diameter of which is smaller than the diameter of the thread of the screw 27. Consequently, an annular shoulder 27B is formed between the thread of the screw and the extension 49. The extension 49 penetrates with a small radial clearance through two plate springs 50 and a bore 51 of the clamping body 20. The plate springs 50 are disposed in a recess 29 in a parallelepipedal projection 22 of the clamping body 20. The lower end of the extension 49 remote from the retaining body 16 has a rivet head 52 engaging the bottom of the clamping body 20 and thus secures the locking screw 27 captively to the locking body. The annular shoulder 27B between the thread of the screw and the extension 49 is in contact with the adjacent plate spring 50 and serves as an axial pressure surface to transmit the force due to the forcible separation of the clamping body 20 from the retaining foot 16 by the locking screw 27 to the plate spring 50 when the locking screw is tightened. The length of the extension 49 is so dimensioned that the plate springs 50 are practically completely untensioned when the annular shoulder 27B lies against the adjacent plate spring 50 and the rivet head 52 is lying against the bottom of the clamping body 20. In this way it is achieved that on slackening the locking screw 27 the clamping body 20 is moved towards the retaining foot 16 by way of extension 49 and its rivet head 52, whereby to facilitate the mounting of the terminal 45 on the rail 40. Finally, it is to be noted also that the parallelepipedal projection 22 of the clamping body 20 as well as the corresponding recess 23 of the retaining foot 16 are each of greater dimension in the direction transverse to the longitudinal direction of the contact rail 40 than in the first embodiment according to FIG. 1. In this way, the mutually opposite guiding surface pairs, 24 and 25 are disposed further away from the longitudinal axis of the locking screw 27 which provides an improved securing of the clamping body 20 against rotation relative to the retaining foot 16, compared with the first embodiment, given the same manufacturing tolerances.

The mode of use and operation of the terminal according to FIGS. 3 and 4 is the same as was given in detail with reference to FIGS. 1 and 2.

Clearly, variants of the second embodiment of the terminal according to the invention could equally be matched to a standardised contact bar according to DIN 46277, Sheet 2, 3 or 4 or to a similar rail with other cross-sectional dimensions instead of the rail according to European Standard EN 50022.

I claim as my invention:

1. An electric terminal for attachment to a contact bar of U-shaped cross-section having a web, a pair of spaced apart limbs and coplanar, spaced-apart, outwardly directed flanges at the ends of the limbs of the U-shaped bar, the said terminal comprising a retaining foot, claws on said retaining foot extending towards each other for gripping the two flanges of the contact bar, a respective recess defined between each claw and the retaining foot for accommodating one of the flanges of the contact bar, a terminal clamping body with two opposed end portions each of which engages in one of said recesses, the end portions bearing in use against the surfaces of the contact bar flanges remote from the web of the U-shaped contact bar; the said terminal clamping body being connected with the retaining foot by a locking screw to enable the terminal clamping body to be forced away from the retaining foot in order rigidly to clamp each of the two flanges of the contact bar between one of the claws and one of the end portions of the terminal clamping body, respectively; the clear spacing between the mutually facing ends of the claws and the depth of each said recess measured in the same direction being so selected in relation to the total width of the contact bar that when the locking screw is slackened the said terminal can be displaced in a direction transverse to the longitudinal direction of the contact bar until one of the claws is disengaged from the adjacent flange of the contact bar, whereby to enable the terminal to be mounted or demounted from the contact bar at any desired position along the contact bar, and the said terminal having two mutually opposed inclined surfaces adapted to co-operate with the contact bar to centre the said terminal relative to the cross-section of the contact bar.

2. A terminal according to claim 1 in which said inclined surfaces are located at the side of the terminal clamping body remote from the retaining foot.

3. A terminal according to claim 1, in which the terminal clamping body and the retaining foot have at their mutually facing sides respectively at least one projection and recess to form guiding surfaces which are in sliding engagement with each other, even when the end portions of the terminal clamping body bear directly against the claws, in order to secure the terminal clamping body against rotation relative to the retaining foot and against displacement toward the claws of the retaining foot; and wherein the terminal clamping body has a parallelepipedal projection on its side facing the retaining foot and the retaining foot has a groove with parallel flanks into which groove the projection of the terminal clamping body slidingly engages, said locking screw engaging with a threaded bore penetrating through the retaining foot and having an axial pressure surface which co-operates with at least one spring element which latter is disposed in a recess in the projection of the terminal clamping body.

4. A terminal according to claim 2, in which the terminal clamping body and the retaining foot have at their mutually facing sides respectively at least one projection and recess to form guiding surfaces which are in sliding engagement with each other, even when the end portions of the terminal clamping body bear directly against the claws, in order to secure the terminal clamping body against rotation relative to the retaining foot and against displacement toward the claws of the retaining foot; and wherein the terminal clamping body has a parallelepipedal projection on its side facing the retaining foot and the retaining foot has a groove with parallel flanks into which groove the projection of the terminal clamping body slidingly engages, said locking screw engaging with a threaded bore penetrating through the retaining foot and having an axial pressure surface which co-operates with at least one spring element which latter is disposed in a recess in the projection of the terminal body.

5. A terminal according to claim 3 in which the locking screw has a cylindrical extension which penetrates through the spring element and through a bore in the terminal clamping body with radial play and at its end has a widened portion engaging the bottom side of the terminal clamping body, whereby the terminal clamping body is inseparably connected with the locking screw.

6. A terminal according to claim 4 in which the locking screw has a cylindrical extension which penetrates through the spring element and through a bore in the terminal clamping body with radial play and at its end has a widened portion engaging the bottom side of the terminal clamping body, whereby the terminal clamping body is inseparably connected with the locking screw.

7. A terminal according to claim 1, in which two cable clip devices are arranged at the side of the retaining foot remote from the claws and the terminal clamping body, the locking screw being accessible between these cable clips for turning.

8. A terminal according to claim 2, in which two cable clip devices are arranged at the side of the retaining foot remote from the claws and the terminal clamping body, the locking screw being accessible between these cable clips for turning.

* * * * *